US008943618B2

(12) United States Patent
Dundas et al.

(10) Patent No.: US 8,943,618 B2
(45) Date of Patent: Feb. 3, 2015

(54) TOILET SEAT HINGE ASSEMBLY

(75) Inventors: Garnet Dundas, Wheatley (CA); Edward Keck, Leamington, CA (US)

(73) Assignee: Centoco Plastics Limited, Windsor (CA)

( * ) Notice: Subject to any disclaimer, the term of this patent is extended or adjusted under 35 U.S.C. 154(b) by 581 days.

(21) Appl. No.: 13/181,017

(22) Filed: Jul. 12, 2011

(65) Prior Publication Data

US 2012/0011646 A1 Jan. 19, 2012

Related U.S. Application Data

(60) Provisional application No. 61/363,791, filed on Jul. 13, 2010.

(51) Int. Cl.
*A47K 13/12* (2006.01)
*A47K 13/26* (2006.01)

(52) U.S. Cl.
CPC ..... *A47K 13/12* (2013.01); *A47K 13/26* (2013.01)
USPC ..... 4/240

(58) Field of Classification Search
CPC ..... A47K 13/00; A47K 13/12
USPC ..... 4/234–242.1
See application file for complete search history.

(56) References Cited

U.S. PATENT DOCUMENTS 2,593,534 A * 4/1952 Campanelli ..... 4/240
2,952,504 A * 9/1960 Path ..... 346/107.2
3,055,015 A * 9/1962 Silverman ..... 4/240
3,063,063 A * 11/1962 Brooks ..... 4/236
3,570,021 A * 3/1971 Watson ..... 4/240
3,653,077 A 4/1972 Warnberg
4,079,471 A * 3/1978 Corda ..... 4/240
4,159,548 A * 7/1979 Hewson ..... 4/236
4,319,365 A * 3/1982 Bemis et al. ..... 4/236
4,326,307 A * 4/1982 Baillie et al. ..... 4/236
4,384,375 A * 5/1983 Gerome ..... 4/240
4,416,048 A * 11/1983 Otte ..... 29/525.04
4,467,481 A * 8/1984 Ginsburg ..... 4/240
5,175,891 A * 1/1993 Ohshima et al. ..... 4/236
5,396,663 A * 3/1995 Burgess ..... 4/237
5,457,824 A * 10/1995 Reed ..... 4/234
5,608,921 A * 3/1997 Barrett et al. ..... 4/239
5,638,554 A * 6/1997 Corzine ..... 4/236
5,918,321 A * 7/1999 Olle ..... 4/236
5,933,875 A * 8/1999 Hulsebus et al. ..... 4/240
6,070,295 A * 6/2000 Hulsebus ..... 16/254
6,101,640 A * 8/2000 Brewer et al. ..... 4/236
6,338,167 B1 * 1/2002 Baker et al. ..... 4/234
6,381,762 B1 * 5/2002 Moser ..... 4/240

(Continued)

FOREIGN PATENT DOCUMENTS

DE 4409516 9/1994
EP 0619976 10/1994

*Primary Examiner* — Lori Baker
(74) *Attorney, Agent, or Firm* — Dykema Gossett PLLC

(57) ABSTRACT

A toilet seat hinge assembly that includes: a hinge configured for attachment to a toilet seat, a fastener including an expandable head; and a cap formed integrally with the hinge. The cap includes an engaging element extending from the first surface of the cap. The engaging element is configured to engage and expand the head of the fastener in order to releasably connect the toilet seat hinge assembly to a toilet bowl when the cap is in a first position relative to the base portion. A toilet seat assembly including the toilet seat hinge assembly.

21 Claims, 2 Drawing Sheets

(56) References Cited

U.S. PATENT DOCUMENTS

| | | | | |
|---|---|---|---|---|
| D481,924 | S | 11/2003 | Hulsebus | |
| 6,643,851 | B1 * | 11/2003 | Janes | 4/236 |
| 6,763,529 | B1 * | 7/2004 | Richter | 4/240 |
| 6,807,686 | B1 * | 10/2004 | Janes | 4/234 |
| 6,931,672 | B1 * | 8/2005 | Richter | 4/240 |
| 7,155,748 | B2 * | 1/2007 | Vierkant et al. | 4/240 |
| 7,389,549 | B2 * | 6/2008 | Vierkant, III | 4/236 |
| 2004/0223829 | A1 * | 11/2004 | Barnett et al. | 411/433 |
| 2006/0113504 | A1 * | 6/2006 | Tollin | 251/257 |
| 2008/0172780 | A1 * | 7/2008 | Shiau | 4/236 |
| 2009/0113610 | A1 * | 5/2009 | Lin et al. | 4/240 |
| 2012/0011646 | A1 * | 1/2012 | Dundas et al. | 4/420 |

* cited by examiner

TOILET SEAT HINGE ASSEMBLY

CROSS REFERENCE TO RELATED APPLICATIONS

This application claims the benefit of U.S. Provisional Patent Application No. 61/363,791, filed Jul. 13, 2010, which is hereby incorporated by reference as though fully set forth herein.

BACKGROUND OF INVENTION a. Field of the Invention

The invention relates generally to a toilet seat hinge assembly, and more particularly, to a toilet seat hinge assembly including a hinge, a fastener extending through at least a portion of the hinge and having an expandable head, and a cap formed integrally with the hinge, where the cap includes an engaging element configured to engage and expand the expandable head of the fastener in order to releasably connect the toilet seat hinge assembly to the toilet bowl.

b. Description of Related Art

A wide variety of hinge mechanisms for toilet seats exist in order to attempt to address consumer demands for toilet seat stability, easy removal and replacement for cleaning purposes, and a desirable aesthetic. However, many hinge mechanisms continue to require complicated steps for removal and replacement of a toilet seat, including unscrewing and screwing nuts in an area of limited space. In addition, many hinge mechanisms require a relatively high part count, thereby increasing the complexity and cost of the device. Furthermore, many hinge mechanisms are not aesthetically pleasing due to the inclusion of various "seams" where different parts or components of the hinge mechanism meet.

Accordingly, there remains a need for a toilet seat hinge assembly that allows for quick, tool-free removal of the toilet seat, while reducing part count and complexity and improving overall aesthetic design of the assembly.

SUMMARY OF THE INVENTION

The present invention provides a toilet seat hinge assembly. The toilet seat hinge assembly includes a hinge configured for attachment to a toilet seat. The hinge comprises: a base portion having an opening extending therethough; a head portion connected to the base portion; and a connecting element extending from the head portion. The connecting element is configured to connect the hinge to the toilet seat. The toilet seat hinge assembly further includes a fastener. The fastener comprises: a shank configured for extending through the opening of the base portion and configured for connection to a toilet bowl; and a head, wherein the head is expandable. The toilet seat hinge assembly further includes a cap formed integrally with the hinge. The cap includes a first surface, a second surface opposing the first surface, and an engaging element extending from the first surface of the cap. The engaging element is configured to engage and expand the head of the fastener in order to releasably connect the toilet seat hinge assembly to the toilet bowl when the cap is in a first position relative to the base portion of the hinge. In accordance with an embodiment of the invention, the head of the fastener is formed integrally with the shank. The engaging element is also configured to disengage from the head of the fastener when the cap is in a second position relative to the base portion.

In accordance with an embodiment of the invention, the fastener further comprises a radially outwardly extending flange and the base portion further comprises a recess configured to receive the radially outwardly extending flange. In accordance with an embodiment of the invention, at least one of the base portion and the head portion includes a slot and the cap includes a clip configured for engagement with the slot. In accordance with an embodiment of the invention, a living hinge connects the cap to the hinge and is configured to allow pivotal movement of the cap. The cap is configured to pivotally move in a direction toward the hinge pin for allowing the engaging member to engage and expand the head of the fastener and is configured to pivotally move in a direction away from the hinge pin to allow the engaging member to disengage from the head of the fastener.

In accordance with an embodiment of the invention, the head of the fastener comprises a segmented ring having a plurality of segments. Each of the plurality of segments elastically deforms radially outwardly when the engaging element of the cap engages the head of the fastener. Each of the plurality of segments includes a corresponding detent. Each corresponding detent of the plurality of segments is configured to engage at least a portion of the base portion of the hinge near the opening in the base portion when each of the plurality of segments is elastically deformed radially outwardly. An outer diameter of the segmented ring including the corresponding detents of each of the plurality of segments is smaller than a diameter of the opening in the base portion of the hinge when the engaging element of the cap is disengaged from the head of the fastener.

In accordance with another embodiment of the invention, a toilet seat assembly is provided including: a toilet seat; a toilet bowl; and a toilet seat hinge assembly configured to connect the toilet seat and the toilet bowl. The toilet seat hinge assembly includes a hinge configured for attachment to a toilet seat. The hinge comprises: a base portion having an opening extending therethough; a head portion connected to the base portion; and a connecting element extending from the head portion. The connecting element is configured to connect the hinge to the toilet seat. The toilet seat hinge assembly further includes a fastener. The fastener comprises: a shank configured for extending through the opening of the base portion and configured for connection to a toilet bowl; and a head, wherein the head is expandable. The toilet seat hinge assembly further includes a cap formed integrally with the hinge. The cap includes a first surface, a second surface opposing the first surface, and an engaging element extending from the first surface of the cap. The engaging element is configured to engage and expand the head of the fastener in order to releasably connect the toilet seat hinge assembly to the toilet bowl when the cap is in a first position relative to the base portion of the hinge. In accordance with an embodiment of the invention, the head of the fastener is formed integrally with the shank. The engaging element is also configured to disengage from the head of the fastener when the cap is in a second position relative to the base portion. In accordance with an embodiment of the invention, the head of the fastener is formed integrally with the shank.

A toilet seat hinge assembly and a toilet seat assembly in accordance with the present invention is advantageous as compared to existing hinge assemblies because they allow for tool-free removal of a toilet seat from a toilet bowl. Accordingly, the toilet seat hinge assembly and toilet seat assembly allow for relatively easy and quick removal and subsequent replacement of a toilet seat from a toilet bowl for cleaning purposes. By integrating the cap and the hinge, the number of parts of the toilet seat hinge assembly may be decreased, resulting in a decrease in the complexity and cost of the assembly. Moreover, by integrating the cap and the hinge, the aesthetics of the toilet seat hinge assembly may be improved by removing visible seams where various parts or components may be connected. In addition, by integrating the expandable head of the fastener with the shank, the number of parts of the toilet seat hinge assembly may be further decreased to reduce complexity and cost of the assembly. Also, by including a releasable clip mechanism that is configured to cooperate with the existing base portion of the hinge, the part count of the toilet seat hinge assembly may be reduced and the complexity of the toilet seat hinge assembly may be further simplified. Finally, by including a recess in the bottom wall of the base portion of the hinge to receive a corresponding flange on the fastener, alignment and mating of the hinge and fastener may be improved.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention and together with the detailed description serve to explain the principles of the invention. In the drawings.

DETAILED DESCRIPTION OF THE PREFERRED EMBODIMENT

Figure 1:
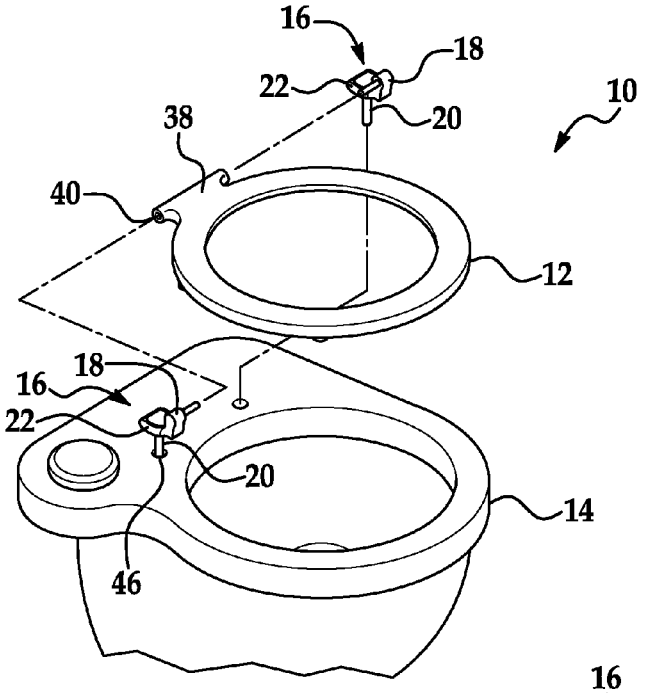
FIG. 1 is a perspective view of a toilet including a toilet seat, a toilet bowl, and a toilet seat hinge assembly in accordance with an embodiment of the invention.
Figure 2:
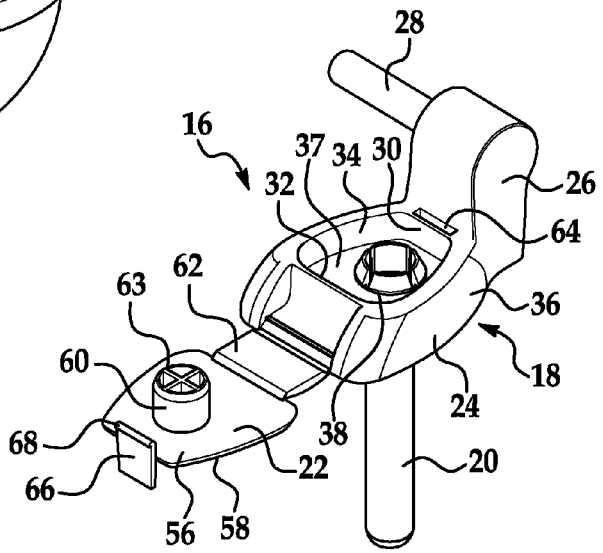
FIG. 2 is a perspective view of the toilet seat hinge assembly of FIG. 1 in accordance with an embodiment of the invention.

Referring now to the drawings wherein like reference numerals designate corresponding parts throughout the several views, FIG. 1 is a perspective view of a toilet assembly 10 including a toilet seat 12, a toilet bowl 14, and toilet seat hinge assemblies 16 in accordance with an embodiment of the invention. The toilet seat 12 and the toilet bowl 14 are conventional in the art. FIG. 2 illustrates a perspective view of the toilet seat hinge assembly 16 in accordance with an embodiment of the invention. Referring now to FIGS. 1-2, the toilet seat hinge assembly 16 comprises a hinge 18, a fastener 20, and a cap 22.

Figure 6:
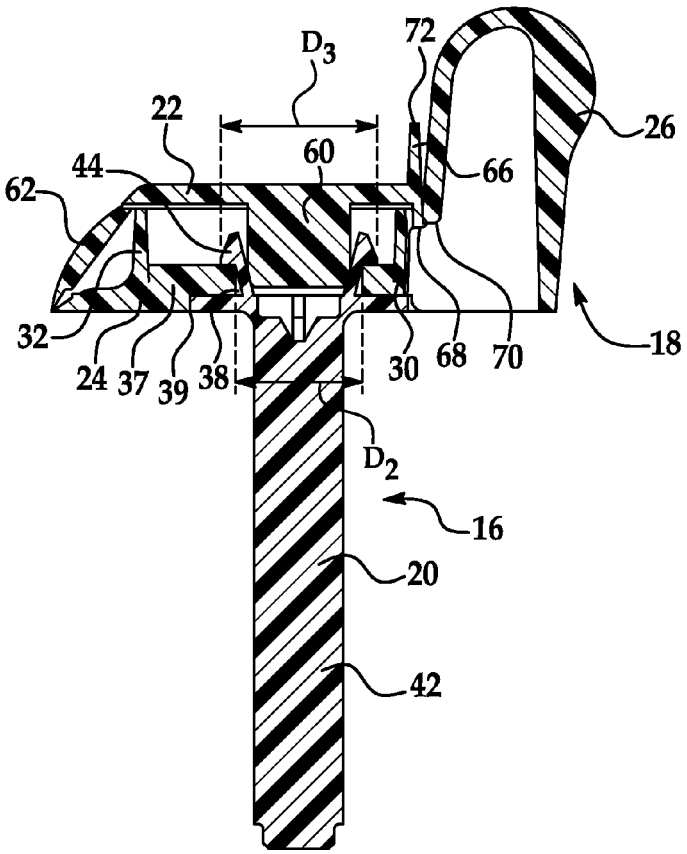
FIG. 6 is a cross-sectional view of the toilet seat hinge assembly of FIG. 5, taken along line 6-6.

The hinge 18 is configured for attachment to the toilet seat 12 and the toilet bowl 14. Referring now to FIGS. 2 and 6, the hinge 18 comprises a base portion 24, a head portion 26, and a connecting element 28. The base portion 24 can be generally trapezoidal in shape having two generally parallel side walls 30, 32 of unequal length and two non-parallel side walls 34, 36 of generally equal length extending between generally parallel walls 30, 32. The base portion further includes a bottom wall 37. The bottom wall 37 of the base portion 24 includes an opening 38 extending therethrough. Referring now to FIG. 6, the bottom wall 37 of the base portion 24 further includes a recess 39 in the bottom surface of the bottom wall 37.

Figure 5:
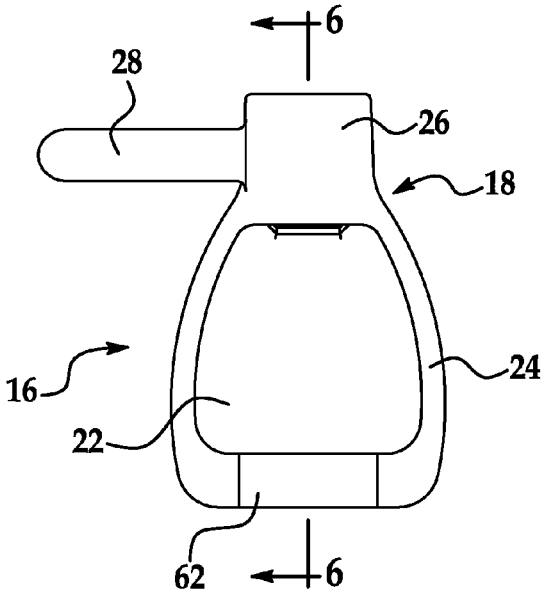
FIG. 5 is a top plan view of the toilet seat hinge assembly of FIGS. 1-2 in accordance with an embodiment of the invention.

Referring again to FIGS. 1-2 and 5-6, the head portion 26 of the hinge 18 is connected to the base portion 24. The connecting element 28 connects the hinge 18 to the toilet seat 12. For example, the connecting element 28 can comprise a hinge pin 28 as generally illustrated in FIGS. 2 and 5. The hinge pin 28 extends from the head portion 26. The hinge pin 28 is configured to be received by at least a portion of the toilet seat 12 and allow for pivotal movement of the toilet seat 12. In particular, the toilet seat 12 may include a protrusion 38 extending from a rear portion of the toilet seat 12. The protrusion 38 may include one or more apertures 40 configured to receive the hinge pin 28 of the hinge 18. Although a hinge pin 28 is described and illustrated, any other number of connecting elements 28 can be utilized in other embodiments of the invention. For example and without limitation, the connecting element 28 can comprise an aperture configured to receive a corresponding hinge pin that is disposed on the toilet seat.

Figure 3:
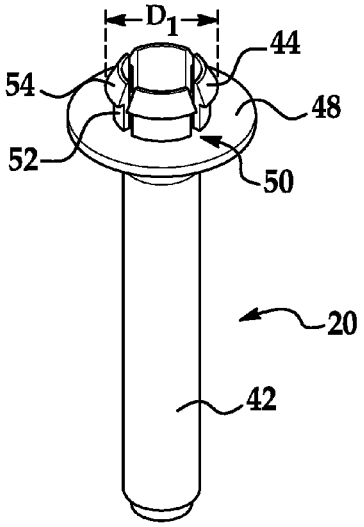
FIG. 3 is a perspective view of a fastener of the toilet seat hinge assembly of FIGS. 1-2 in accordance with an embodiment of the invention.

Referring now to FIGS. 1-3 and 6, the toilet seat hinge assembly 16 further comprises fastener 20. Fastener 20 is configured for attachment to the toilet bowl 14. Fastener 20 comprises a bolt in accordance with an embodiment of the invention. Although a bolt is mentioned in detail, fastener 20 may comprise any number of other fasteners known to those of ordinary skill in the art. Referring now to FIGS. 2-3, the fastener 20 includes a shank 42 and a head 44. Shank 42 is configured to extend through the opening 38 in the base portion 24 of the hinge 18 and through an aperture 46 in the toilet bowl 14. A nut (not shown) may be utilized and threaded onto the shank 42 in order to secure the fastener 20 to the toilet bowl 14 in a conventional manner. Fastener 20 may further include a radially outwardly extending flange 48 located between the shank 42 and the head 44 on the fastener 20. The flange 48 may be configured to extend over the toilet bowl 14 when the shank 42 extends through the aperture 46 in the toilet bowl 14. Referring now to FIG. 6, the flange 48 may be configured to correspond and/or fit into the recess 39 of the bottom wall 37 of the base portion 24 of the hinge 18. Accordingly, the recess 39 of the bottom wall 37 of the base portion 24 is configured to receive the radially outwardly extending flange 48. The use of the flange 48 and corresponding recess 39 may help ensure that the hinge 18 is properly aligned with the fastener 20 and improve mating between the hinge 18 and the fastener 20. Referring back to FIGS. 1-3 and 6, the fastener 20 may be configured to remain attached to the toilet bowl 14 even when the toilet seat hinge assembly 16 and/or toilet seat 12 are removed from the toilet bowl 14. Accordingly, the toilet seat hinge assembly 16 may be particularly advantageous for allowing easy and tool-free removal and replacement of a toilet seat 12 from a toilet bowl 14 for cleaning purposes and the like, since removal of the fastener 20 and/or nut is not required.

Figure 4:
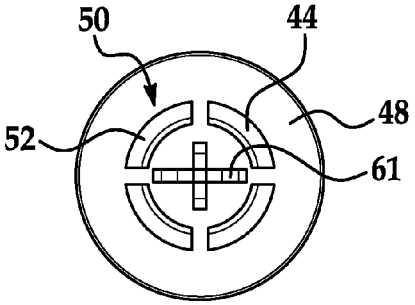
FIG. 4 is a top plan view of the fastener of FIG. 3 in accordance with an embodiment of the invention.

Referring now to FIGS. 3-4, the head 44 of the fastener 20 is configured to be expandable. In particular, the head 44 of the fastener 20 comprises a segmented ring 50 having a plurality of arcuate segments 52. For example and without limitation, the head 44 may comprise about four arcuate segments 52. Although four arcuate segments 52 are mentioned in detail, the head 44 may comprise fewer or more arcuate segments 52 in accordance with other embodiments of the invention. Each of the plurality of arcuate segments 52 includes a corresponding detent 54. An outer diameter $D_1$ of the segmented ring 50 including the corresponding detents 54 of each of the plurality of arcuate segments 52 is smaller than a diameter $D_2$ of the opening 38 in the base portion 24 of the hinge 18 when the cap 22 is disengaged from the head 44 of the fastener 20.

Each of the plurality of arcuate segments 52 of the segmented ring 50 is configured to elastically deform radially outwardly as generally illustrated in FIG. 6 and as described in more detail hereinbelow. When each of the plurality of arcuate segments 52 is elastically deformed radially outwardly, each corresponding detent 54 of each of the plurality of arcuate segments 52 is configured to engage at least a portion of the base portion 24. In particular, each corresponding detent 54 of each of the plurality of arcuate segments 52 is configured to engage the bottom wall 37 of the base portion 24 that defines opening 38. In particular, a bottom of each corresponding detent 54 of each of the plurality of arcuate segments 52 may engage a top surface of the bottom wall 37 of the base portion 24 that defines opening 38. Accordingly, an outer diameter $D_3$ of the segmented ring 50 including the corresponding detents 54 of each of the plurality of arcuate segments 52 is greater than a diameter $D_2$ of the opening 38 in the base portion 24 of the hinge 18 when the cap 22 is engaged with the head 44 of the fastener 20. Although the segments 52 are described as being arcuate in shape, the segments 52 may be any number of other shapes in accordance with other embodiments of the invention.

Referring back to FIG. 3, in accordance with an embodiment of the invention, the head 44 of the fastener 20 is formed integrally with the shank 42. By forming the expandable head 44 of the fastener 20 integrally with the shank 42, the part count for the toilet seat hinge assembly 16 is reduced and the simplicity of the assembly 16 is improved.

Referring to FIGS. 2 and 5-6, in particular, the toilet seat hinge assembly 16 further comprises cap 22. Cap 22 is configured to close over the opening 38 of the base portion 24 of the hinge 18 and expand the expandable head 44 of the fastener 20. Cap 22 includes a first surface 56 and a second surface 58 opposing the first surface. Cap 22 further includes an engaging element 60 extending from the first surface 56 of the cap 22. The engaging element 60 is generally cylindrical in shape. Although a cylindrical shape is mentioned in detail, the engaging element 60 may be any number of shapes (for example and without limitation, rectangular, triangular, etc.) in accordance with other embodiments of the invention. The engaging element 60 is configured to engage and expand the head 44 of the fastener 20 in order to releasably connect the toilet seat hinge assembly 16 to the toilet bowl 14 when the cap 22 is in a first position relative to the base portion 24. The first position of the cap 22 is generally illustrated in FIG. 6. Each of the plurality of arcuate segments 52 of the segmented ring 50 is configured to elastically deform radially outwardly when the engaging element 60 of the cap 22 engages the head 44 of the fastener 20. However, when the engaging element 60 of the cap 22 is disengaged from the head of the fastener 20, and the cap 22 is in a second position relative to the base portion 24 of the hinge 18 as generally illustrated in FIG. 2, each of the plurality of arcuate segments 52 of the segment ring are not deformed radially outwardly and instead are in a default, retracted position in which the outer diameter $D_1$ of the segmented ring 50 including each of the plurality of detents 54 is smaller than the diameter $D_2$ of the opening 38 in the base portion 24 of the hinge 18. Referring to FIGS. 2 and 4, in particular, the fastener 20 can include a predefined pattern of slots 61 configured to correspond to a predefined pattern of projections 63 on the engaging element 60 of the cap 22. The predefined pattern of slots 61 and projections 63 may help to ensure that the fastener 20 and the cap 22 are properly aligned for engagement during insertion of the engaging element 60 into the head 44 of the fastener 20.

Cap 22 is formed integrally with the hinge 18. By integrating the cap 22 and hinge 18, the number of parts of the toilet seat hinge assembly 16 may be decreased, resulting in a decrease in the complexity and cost of the toilet seat hinge assembly 16. Moreover, by integrating the cap 22 and the hinge 18, the aesthetics of the toilet seat hinge assembly 16 may be improved by removing visible "seams" where various parts or components may be connected. A living hinge 62 may connect the cap 22 to the hinge 18. The living hinge 62 is a thin, flexible section made from plastic that connects the cap 22 and the hinge 18, allowing bending along the line of the hinge 62. The cap 22 can be formed integrally with the hinge 18 as a single, one-piece, unitary part. In particular, the cap 22, living hinge 62, and hinge 18 may be manufactured in an injection molding operation that creates all three components at one time as a single part. The cap 22, living hinge 62, and hinge 18 may be formed from a plastic such as polyethylene, or polypropylene, or a combination thereof in accordance with an embodiment of the invention. Although polyethylene and polypropylene are mentioned in detail, the cap 22, living hinge 62, and hinge 18 may be formed from other plastics in accordance with other embodiments of the invention.

Referring now to FIGS. 2 and 5-6, the living hinge 62 is configured to allow pivotal movement of the cap 22. In particular, the cap 22 is configured to pivotally move in a first direction toward the hinge pin 28 (or toward the front of the toilet bowl 14) for causing the engaging member 60 to engage and expand the head 44 of the fastener 20. The cap 22 is configured to pivotally move in a second direction away from the hinge pin 28 (or toward the rear of the toilet bowl 14) for disengaging the engaging member 60 from the head 44 of the fastener 22.

Referring now to FIG. 2, at least one of the base portion 24 and the head portion 26 of the hinge 18 includes a slot 64. The slot 64 is generally rectangular in shape in accordance with an embodiment of the invention. Although the slot 64 is described as being rectangular in shape, the slot 64 may comprise any number of shapes in accordance with other embodiments of the invention. The slot 64 is generally located at or near wall 30 of the base portion 24 proximate the head portion 26. The slot 64 is configured to receive a corresponding clip 66 located on the cap 22. The clip 66 is configured for engagement with the slot 64. The clip 66 may include a first end 68. First end 68 is generally curved in accordance with an embodiment of the invention. When the clip 66 is inserted into slot 64, the first end 68 of the clip may hook onto a portion 70 of the head portion 26 of the hinge 18, thereby releasably securing the cap 22 to the hinge 18 in the closed position generally shown in FIG. 5. The clip 66 may also include a second end 72 opposing the first end 68. In order to release the cap 22 from the hinge 18, the second end 72 of the clip 66 may be moved toward the head portion 26 of the hinge 18, thereby releasing the first end of the clip 66 from the portion 70 of the head portion 26 of the hinge 18, allowing the cap 22 to be released from the hinge in the open position generally shown in FIG. 2. Accordingly, the slot 64 and the clip 66 function as a retention mechanism that may be used to releasably retain the cap 22 in place relative to the hinge 18 when it is desirable for the cap 22 to be in a closed position as generally shown in FIG. 5 and may allow for the release of the clip 66 from the slot 64 when it is desirable for the cap 22 to be in an open position as generally shown in FIG. 2. The clip 66 and slot 64 thereby cooperate with the existing base portion 24 and/or head portion 26 of the hinge 18 in order to improve the simplicity of the toilet seat hinge assembly 16 and further reduce part count.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims. It is intended that the scope of the invention be defined by the claims appended hereto and their equivalents.

What is claimed is:

1. A toilet seat hinge assembly, comprising:

a hinge configured for attachment to a toilet seat and a toilet bowl, the hinge comprising:

a base portion having an opening extending therethough;

a head portion connected to the base portion; and a connecting element extending from the head portion, the connecting element configured to connect the hinge to the toilet seat;

a fastener comprising:

a shank configured for extending through the opening of the base portion and configured for connection to the toilet bowl; and a head, wherein the head is expandable, and wherein the fastener further comprises a radially outwardly extending flange and wherein the base portion further comprises a recess configured to receive the radially outwardly extending flange; and a cap formed integrally with the hinge, the cap including:

a first surface;

a second surface opposing the first surface; and an engaging element extending from the first surface of the cap, wherein the engaging element is configured to engage and expand the head of the fastener in order to releasably connect the toilet seat hinge assembly to the toilet bowl when the cap is in a first position relative to the base portion.

2. The assembly of claim 1, wherein the head of the fastener is formed integrally with the shank.

3. The assembly of claim 1, wherein the engaging element is configured to disengage from the head of the fastener when the cap is in a second position relative to the base portion.

4. The assembly of claim 1, wherein at least one of the base portion and the head portion of the hinge includes a slot.

5. The assembly of claim 4, wherein the cap includes a clip configured for engagement with the slot.

6. The assembly of claim 1, further comprising a living hinge connecting the cap to the hinge.

7. The assembly of claim 6, wherein the living hinge is configured to allow pivotal movement of the cap.

8. The assembly of claim 7, wherein the connecting element comprises a hinge pin, and wherein the cap is configured to pivotally move in a direction toward the hinge pin to allow the engaging member to engage and expand the head of the fastener.

9. The assembly of claim 7, wherein the connecting element comprises a hinge pin, and wherein the cap is configured to pivotally move in a direction away from the hinge pin to allow the engaging member to disengage from the head of the fastener.

10. The assembly of claim 1, wherein the head of the fastener comprises a segmented ring having a plurality of segments.

11. The assembly of claim 10, wherein each of the plurality of segments elastically deforms radially outwardly when the engaging element of the cap engages the head of the fastener.

12. The assembly of claim 11, wherein each of the plurality of segments includes a corresponding detent.

13. The assembly of claim 12, wherein each corresponding detent of the plurality of segments is configured to engage at least a portion of the base portion of the hinge near the opening in the base portion when each of the plurality of segments is elastically deformed radially outwardly.

14. The assembly of claim 12, wherein an outer diameter of the segmented ring including the corresponding detents of each of the plurality of segments is smaller than a diameter of the opening in the base portion of the hinge when the engaging element of the cap is disengaged from the head of the fastener.

15. A toilet seat assembly comprising:

a toilet seat;

a toilet bowl; and a toilet seat hinge assembly configured to connect the toilet seat and the toilet bowl, the toilet seat hinge assembly comprising:

a hinge configured for attachment to the toilet seat and a toilet bowl, the hinge comprising:

a base portion having an opening extending therethough;

a head portion connected to the base portion; and a connecting element extending from the head portion, the connecting element configured to connect the hinge to the toilet seat;

a fastener comprising:

a shank configured for extending through the opening of the base portion and configured for connection to the toilet bowl; and a head, wherein the head is expandable, and wherein the fastener further comprises a radially outwardly extending flange and wherein the base portion further comprises a recess configured to receive the radially outwardly extending flange; and a cap formed integrally with the hinge, the cap including:

a first surface;

a second surface opposing the first surface; and an engaging element extending from the first surface of the cap, wherein the engaging element is configured to engage and expand the head of the fastener in order to releasably connect the toilet seat hinge assembly to the toilet bowl when the cap is in a first position relative to the base portion.

16. The assembly of claim 15, wherein the head of the fastener is formed integrally with the shank.

17. The assembly of claim 15, wherein the engaging element is configured to disengage from the head of the fastener when the cap is in a second position relative to the base portion.

18. The assembly of claim 15, further comprising a living hinge connecting the cap to the hinge, wherein the living hinge is configured to allow pivotal movement of the cap.

19. The assembly of claim 18, wherein the connecting element comprises a hinge pin, and wherein the cap is configured to pivotally move in a direction toward the hinge pin for allowing the engaging member to engage and expand the head of the fastener and wherein the cap is configured to pivotally move in a direction away from the hinge pin to allow the engaging member to disengage from the head of the fastener.

20. The toilet seat hinge assembly of claim 1 wherein said fastener includes a predefined pattern of slots.

21. A toilet seat hinge assembly, comprising:

a hinge configured for attachment to a toilet seat and a toilet bowl, the hinge comprising:

a base portion having an opening extending therethough;

a head portion connected to the base portion; and a connecting element extending from the head portion, the connecting element configured to connect the hinge to the toilet seat;

a fastener comprising:

a shank configured for extending through the opening of the base portion and configured for connection to the toilet bowl; and a head, wherein the head is expandable, and wherein the head is formed integrally with the shank, and wherein the fastener further comprises a radially outwardly extending flange and wherein the base portion further comprises a recess configured to receive the radially outwardly extending flange; and a cap formed integrally with the hinge, the cap including:

a first surface;

a second surface opposing the first surface; and an engaging element extending from the first surface of the cap, wherein the engaging element is configured to engage and expand the head of the fastener in order to releasably connect the toilet seat hinge assembly to the toilet bowl when the cap is in a first position relative to the base portion; and wherein at least one of the base portion and the head portion of the hinge includes a slot, and wherein the cap includes a clip configured for engagement with the slot.

* * * * *